United States Patent [19]

Eguchi et al.

[11] Patent Number: 4,917,052

[45] Date of Patent: Apr. 17, 1990

[54] WATER PUMP APPARATUS IN AN INTERNAL COMBUSTION ENGINE

[75] Inventors: Katsuhiko Eguchi, Kariya; Atsushi Ohmi, Anjo, both of Japan

[73] Assignee: Aisin Seiki Kabushiki Kaisha, Kariya, Japan

[21] Appl. No.: 293,981

[22] Filed: Jan. 6, 1989

[30] Foreign Application Priority Data

Jan. 28, 1988 [JP] Japan ..... 63-009925

[51] Int. Cl.[4] ..... F01P 5/10

[52] U.S. Cl. ..... 123/41.47; 123/198 C

[58] Field of Search ..... 123/41.44, 41.47, 41.46, 123/198 C; 384/275, 271, 272

[56] References Cited

U.S. PATENT DOCUMENTS 1,020,552 3/1912 Henry, Jr. ..... 384/275
2,386,283 10/1945 Wiken et al. ..... 384/271
3,001,517 9/1961 Baker et al. ..... 123/41.47
4,756,280 7/1988 Tamba et al. ..... 123/41.47

FOREIGN PATENT DOCUMENTS 326284 1/1958 Switzerland ..... 384/271

*Primary Examiner*—Noah P. Kamen
*Attorney, Agent, or Firm*—Oblon, Spivak, McClelland, Maier & Neustadt

[57] ABSTRACT

A water pump apparatus in an integral combustion engine of a water cooling type having a driving pulley fixed to one end of a crankshaft, and a driven pulley fixed to one end of a valve camshaft for driving the movable valve camshaft from the crankshaft via a timing belt has a water pump eccentrically providing a pump shaft axis relative to the valve camshaft axis, a pair of drive and driven gears provided with a suitable rotational ratio and respectively mounted on an end of the valve camshaft and one end of the pump shaft and engaged with each other, and a sliding bearing supporting the pump shaft and being inserted in a cylinder head.

10 Claims, 3 Drawing Sheets

1
2
2a
2b
3
3a
4
5
6
7
8
9
9a
10
11
12
13
14
15
16
17

WATER PUMP APPARATUS IN AN INTERNAL COMBUSTION ENGINE

BACKGROUND OF THE INVENTION

1. Field of the Invention

This invention relates to a water pump apparatus, and more particularly to a water pump apparatus which is utilized in an internal combustion engine of a water cooled type.

2. Description of the Related Art

In a conventional apparatus of this type which is published as Japanese Laid Open No. 61(1986)-1819 and shown in FIGS. 3, 4, and 5, a transmitting mechanism T has a drive pulley (driving means) 22 fixedly mounted to one end of a crankshaft 21, a driven pulley (driven means) 24 fixedly mounted to one end of a rotatable valve camshaft 23, and an endless timing belt 25 comprising valve timing means and extending between both pulleys 22, 24. Power is transmitted from the crankshaft 21 to the rotatable valve camshaft 23 via the transmitting mechanism T. The diameter of the drive pulley 22 and the drive pulley 24 are such that the rotational speed of the valve camshaft 23 is one half of the rotational speed of the crankshaft 21.

The other end of the valve camshaft 23 (end opposite to the transmitting mechanism T) is integrally formed with a connecting terminal 23*a* for connecting with a connecting terminal 31*a* integrally formed on a pump shaft 31 of a water pump 30. The water pump 30 is thus connected to the valve camshaft 23 by the connecting terminal 31*a*, and the rotational axis of the pump shaft 31 is coaxial with the rotational axis of the valve camshaft 23. The pump shaft 31 is supported by a plurality of a ball bearing 32 and is lubricated by engine oil.

In the above-mentioned conventional apparatus, the rotational speed of the water pump 30 is changed by the drive and driven pulley ratio to be one half of the crank rotation speed. Accordingly, the water pump 30 must be large in size in order to maintain sufficient flow volume upon increasing demand. Further, since the pump shaft 31 is supported by a ball bearing 32, the outer diameter of a bearing portion becomes larger. Furthermore, the pump shaft 31 and the valve camshaft 23 are coaxially arranged on the same line, so that they are axially extended, and a L-shaped lubricating passage 33 and seal mechanism 34 are required. As a result, there is a problem that an adequate degree of miniaturization cannot be easily attained. There is also a problem that various vehicle and engine specifications require a large variety of water pumps, each having slightly different discharge volume requirements.

SUMMARY OF THE INVENTION

It is therefore an object of the present invention to provide a water pump apparatus which obviates the above drawbacks.

It is another object of the present invention to provide a water pump apparatus which permits size miniaturization.

It is further object of the present invention to provide a water pump apparatus in which water pump apparatuses having different flow volumes can be manufactured on the same assembly line.

In order to accomplish these and other objects, the water pump apparatus of the present invention is provided in an internal combination engine having drive and driven pulleys fixedly connected to one end of a crankshaft and one end of a rotatable valve camshaft in a cylinder head, respectively, and a timing belt for driving the valve camshaft from the crankshaft. The water pump apparatus includes a water pump having a pump shaft positioned eccentrically to the valve camshaft on other end of the valve camshaft, drive and driven gears meshing with a predetermined rotational ratio and respectively mounted on said valve camshaft and said pump shaft, and a sliding bearing supporting the pump shaft and having a bearing portion inserted in the cylinder head. The sliding bearing is integrally formed with a flanged portion on an end surface of a bush or a taper shaped bush.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following, preferred embodiments of the present invention will be described with reference to the drawings.

Figures 1, 2:
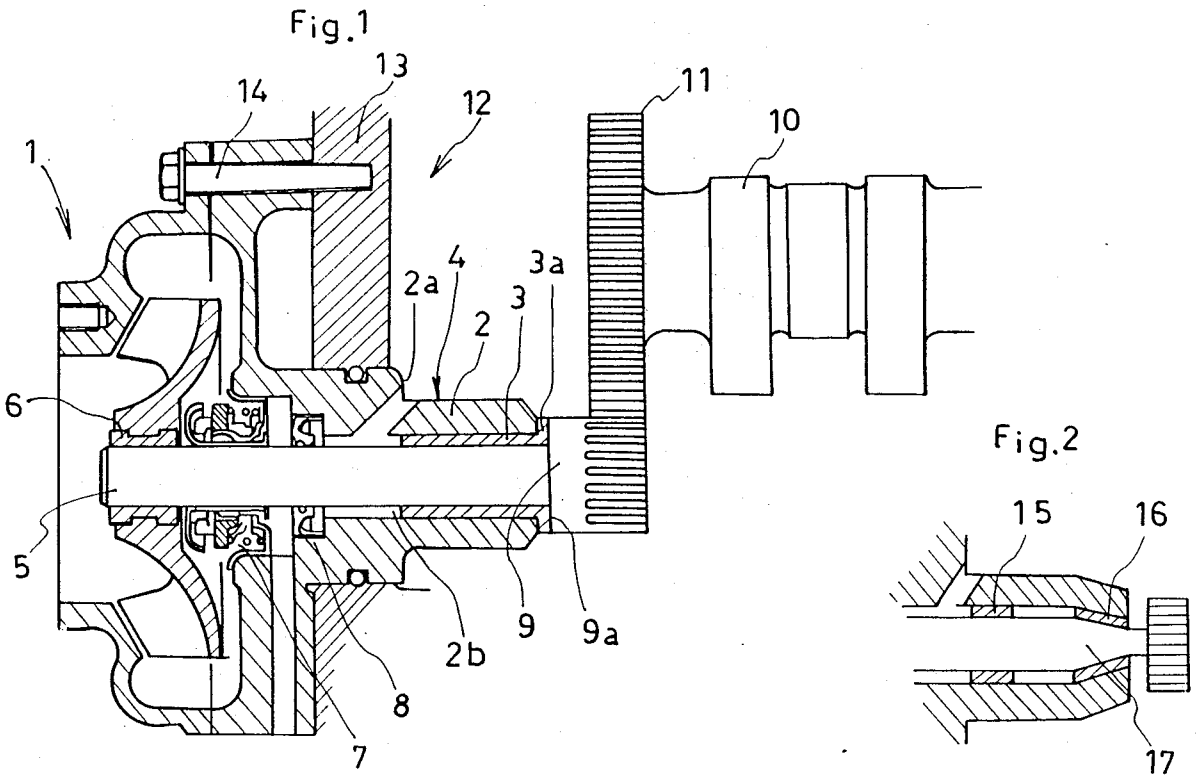
FIG. 1 is a sectional view of one embodiment of a water pump apparatus according to the present invention.
FIG. 2 is a view similar to FIG. 1, but which shows an essential portion having a bush in a tapered shape.
Figure 3:
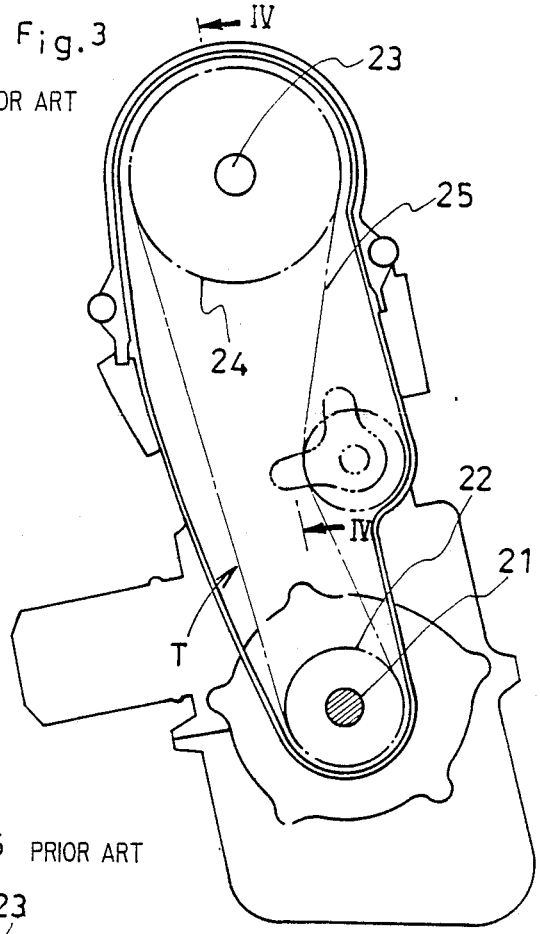
Fig. 3 PRIOR ART
FIG. 3 is a side view of a conventional internal combustion engine.
Figure 5:
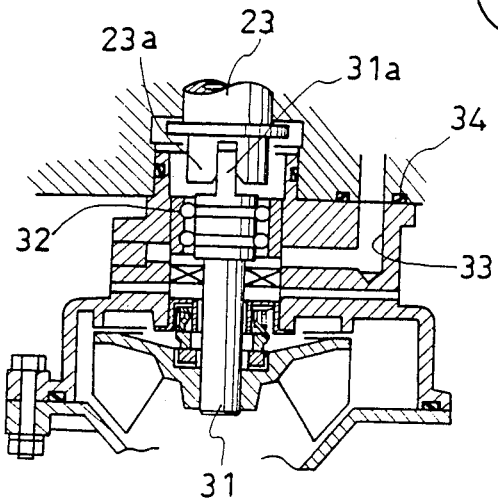
Fig. 5 PRIOR ART
FIG. 5 is a view taken along the line V—V in FIG. 4.
Figure 4:
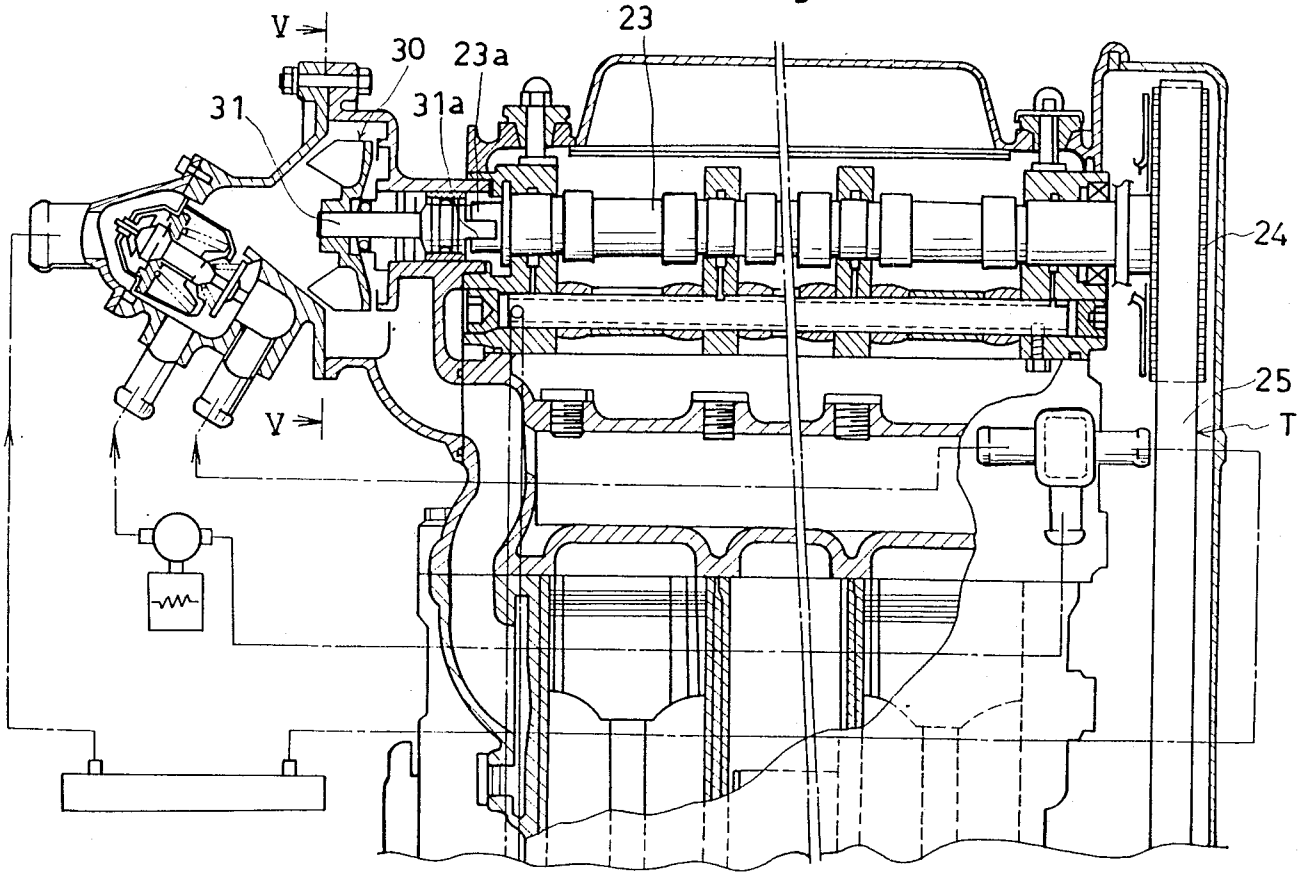
Fig. 4 PRIOR ART
FIG. 4 is an enlarged sectional view taken along the line IV—IV in FIG. 3.

In FIG. 1, a water pump apparatus 1 includes a housing 8 within which is held an impeller 6 mounted on a rotatable pump shaft 5. The water pump apparatus may be part of an engine such as is shown in FIG. 3. A portion of the housing comprises a sliding bearing portion 4 within which is held a bush 3 having a flange portion 3*a* and being fixedly held in the sliding bearing portion 4. The pump shaft 5 is rotatably supported via the bush 3. The impeller 6 (pump means) is fixedly connected to a left end of the pump shaft 5 in this Figure, and well-known mechanical seals 7 are interposed around the pump shaft 5 within the impeller 6 and the sliding bearing portion 4. A driven gear 9 is detachably mounted on a right end of the pump shaft 5 and is supported against axial thrust forces by the flange portion 3*a* of the bush 3 and an end surface 9*a* of the driven gear 9. Such thrust forces act in the direction of the impeller 6 and are applied to the driven gear 9 in reaction to the sucking force of water. An oil introducing passage 2*a* and an oil sump chamber 2*b* are formed in order to lubricate a sliding surface between the bush 3 and the pump shaft 5, and a thrust receiving surface between the flange portion 3*a* and the driven gear 9. The oil introducing passage 2*a* is open upwardly for receiving oil from the engine and is communicated with the oil sump chamber 2*b*. The driven gear 9 meshes with a drive gear 11 formed on a rotatable valve camshaft 10 and is thus rotated with a suitable gear ratio. A driven pulley (not shown but corresponding to that shown in FIG. 3) is fixed to an opposite end of the valve camshaft 10.

The water pump 1 is attached to rear portion 13 of a cylinder head 12 by a bolt 14 at a position where the rotational axis of the pump shaft 5 is eccentric to the rotational axis of valve camshaft 10 and the bearing portion 4 is positioned within the head 12.

In the case where valve camshaft 10 is rotatably driven by a crankshaft (not shown but corresponding to that shown in FIG. 3), the water pump apparatus 1 is driven via means for drivingly connecting the pump shaft with the cam shaft in the form of the drive gear 11 attached to the valve camshaft 10 and the driven gear 9 attached to the pump shaft 5. At this time, the sliding surface of the bearing portion 4 and the thrust surface between the flange portion 3*a* and the driven gear 9 are lubricated by engine oil introduced through the oil introducing passage 2*a* and retained in the oil sump chamber 2*b*.

The gear ratio of drive and driven gears 11, 9 can be set in accordance with a desired pumping volume for the water pump apparatus 1.

The thrust force can instead be supported by the arrangement shown in FIG. 2. Two bushes 15, 16 are there provided and the thrust force is supported by a taper shaped sliding surface of the bush 16 and a taper surface of the pump shaft 17. The lubrication is similar to that in the embodiment of FIG. 1. The two bushes 15, 16 can instead be integrally formed.

As above-mentioned, a driven pulley is fixed to one end of the valve camshaft, the water pump eccentrically locating the pump shaft relative to the valve camshaft is provided on the other end of the valve camshaft. A pair of drive and driven gears having a suitable gear ratio are respectively attached to the other end of the valve camshaft and one end of the pump shaft. The water pump apparatus is driven via the gears, and the pump shaft is supported in a sliding bearing. Therefore, it will be possible that the rotational speed of the water pump transmitted from the valve camshaft, a rotational speed which is one half of the crankshaft rotational speed, can be changed to any desired value. As a result, the water pump can be miniaturized in size by use of a high gear ratio between gears 9 and 11. The main parts of the water pump have essentially the same construction for any desired pumped volume so that the water pumps for all pumped volumes can be manufactured on the same line and cost reductions can be attained.

Since the pump shaft is eccentrically provided relative to the valve camshaft by utilizing a space within the head, the bearing portion is inserted in the head and the axial enlargement of the engine due to the water pump can be reduced. Accordingly, the whole axial length of the engine can be reduced.

The flange portion is integrally formed on the end surface of the bush forming the sliding bearing, so that wear and burning due to thrust force can be prevented.

The bush forming the sliding bearing may instead be formed in a taper shape, so that the wear and burning due to the thrust force can be prevented.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed as new and desired to be secured by letters patent of the United States is:

1. A water pump apparatus in a water cooled internal combustion engine having a cylinder head including a rotatable valve camshaft, comprising:

a water pump including a pump shaft positioned eccentrically to said valve camshaft;

drive and driven gears meshing with a predetermined rotational ratio and respectively mounted on said valve camshaft and said pump shaft; and a sliding bearing supporting said pump shaft and having a bearing portion inserted in the head.

2. A water pump apparatus as set forth in claim 1, wherein said sliding bearing comprises a bush integrally formed with a flanged portion on an end thereof, wherein said driven gear bears on said flanged portion so that said flanged portion comprises an axial thrust bearing means for said driven gear.

3. A water pump apparatus as set forth in claim 1, wherein said sliding bearing comprises a taper shaped bush, and wherein said taper shaped bush comprises an axial thrust bearing means for said driven gear.

4. An internal combustion engine comprising:

a cylinder head;

a crankshaft having driving means at one end thereof;

a camshaft rotatably mounted in said cylinder head and having a driven means at an end thereof;

a valve timing means connecting said driving and driven means, whereby said camshaft is rotatably driven; and a water pump apparatus comprising:

(a) pump means mounted on a rotating pump shaft;

(b) a water pump housing enclosing said pump means and including a bearing portion positioned within said cylinder head, said bearing portion including means for supporting said pump shaft for rotation about an axis eccentric to a rotational axis of said camshaft, whereby a length of said engine may be reduced; and (c) means for drivingly connecting said pump shaft with said camshaft.

5. The engine of claim 4 wherein said means for supporting said pump shaft for rotating comprises a bush fixed in said bearing portion, whereby said bearing portion comprises a sliding bearing portion.

6. The engine of claim 5 wherein said means for drivingly connecting said pump shaft with said camshaft comprises a driven gear mounted to said pump shaft and a driving gear meshing with said driven gear and mounted to an end of said camshaft opposite said driven means, whereby said pump means can be driven with a desired rotational speed as a function of a size ratio between said driving and driven gears.

7. The engine of claim 6 including axial thrust bearing means at said bearing portion.

8. The engine of claim 7 wherein said axial thrust bearing means comprise a flange integral with said bush and abutting said driven gear.

9. The engine of claim 7 wherein said axial thrust bearing means comprise a tapered bush positioned between tapered portions of said pump shaft and said bearing portion.

10. The engine of claim 4 wherein said means for drivingly connecting said pump shaft with said camshaft comprises a driven gear mounted to said pump shaft and a driving gear meshing with said driven gear and mounted to an end of said camshaft opposite said driven means, whereby said pump means can be driven with a desired rotational speed as a function of a size ratio between said driving and driven gears.

* * * * *